United States Patent [19]

Bomford

[11] Patent Number: 4,630,797

[45] Date of Patent: Dec. 23, 1986

[54] CLAMPING YOKE FOR CONCRETE FORMS

[76] Inventor: James A. Bomford, Box 215, Mill Bay, British Columbia, Canada, V0R 2P0

[21] Appl. No.: 700,450

[22] Filed: Feb. 11, 1985

[51] Int. Cl.[4] ..... E04G 11/30

[52] U.S. Cl. ..... 249/20; 249/33; 249/34; 249/219 R

[58] Field of Search ..... 249/219 R, 2, 5, 8, 249/19, 20, 33, 208, 216, 34, 50; 425/65

[56] References Cited

U.S. PATENT DOCUMENTS

| | | | |
|---|---|---|---|
| 849,936 | 4/1907 | Thomas | 249/36 |
| 1,130,647 | 3/1915 | Thompson | 249/33 |
| 1,246,532 | 11/1917 | Bosma | 249/177 |
| 1,414,288 | 4/1922 | Knudson | 249/33 |
| 1,459,889 | 6/1923 | Hoag | 249/27 |
| 1,547,221 | 7/1925 | Lehrack | 249/36 |
| 1,560,293 | 11/1925 | Fels | 425/65 |
| 1,575,959 | 3/1926 | Barstad | 249/33 |
| 1,641,958 | 9/1927 | Bracey | 249/33 |
| 2,719,347 | 10/1955 | Brekke | 249/36 |
| 3,488,028 | 1/1970 | Verburgh | 249/33 |
| 3,659,982 | 5/1972 | Svensson et al. | 249/20 |
| 3,822,854 | 7/1974 | Bondi | 249/33 |
| 3,853,452 | 12/1974 | Delmonte | 249/20 |
| 4,016,228 | 4/1977 | Schmidt | 249/20 |

FOREIGN PATENT DOCUMENTS

| | | | |
|---|---|---|---|
| 150476 | 9/1920 | United Kingdom | 249/219 R |

*Primary Examiner*—Jay H. Woo
*Assistant Examiner*—James C. Housel
*Attorney, Agent, or Firm*—Christie, Parker & Hale

[57] ABSTRACT

A clamping device for concrete forms to apply pressure to opposed panels that contact the concrete to mold it. The device comprises a yoke to enclose the opposed panels. The yoke has a cross member and arms at each end of the cross member extending, when the device is in its useful position, downwardly to surround the panels. Open sides for the arm, each face inwardly, towards the other arm. A pressure member within each arm is reciprocable through the open side of the arm to vary the pressure applied by the pressure member. The pressure members can be forced outwardly.

14 Claims, 11 Drawing Figures

20
28
30
8
24
22
24
4
4
32
46
42
40
38
48
44
16
34
5
5
52
75
6
73
36
72
72
10
50
12
58
54
52
38
40
42
44
46
48
58
18
60
68
56
52
64
70
62
1

CLAMPING YOKE FOR CONCRETE FORMS

FIELD OF THE INVENTION

This invention relates to a device to clamp concrete forms to apply pressure to the forms during the pouring of concrete.

DESCRIPTION OF THE PRIOR ART

In the construction of concrete walls it is often desirable to cast the wall in a series of manageable small sections rather than all at once. The latter procedure entails the use of large quantities of prepared materials, forms and manpower. Conventionally casting in small sections is accomplished by securing two flat boards spaced apart and parallel to each other and then pouring concrete between them. Once the concrete is set another section of wall is cast by placing the lower edge of the form boards against each side of the previously cast wall and then again pouring concrete between the forms. This process is continued until the desired wall height is obtained.

Although this method is more manageable than the casting of a wall in one piece, the disadvantage is that an unsightly ridge or seam can be formed. This is because little or no pressure can be applied to the opposing boards that comprise the form and as a result freshly poured concrete can seep out from underneath the bottom edge of each board and spread over the lower sections. In this regard it must, of course, be remembered that the height of the wet concrete exerts a considerable pressure on the bottom edge of the form.

Forms in which pressure can be applied are known United States patents describing and claiming such equipment include U.S. Pat. Nos. 3,822,854 to Bondi; 1,414,288 to Knudson; 1,459,889 to Hoag; 1,575,959 to Barstad; 1,641,958 to Bracey; 849,936 to Thomas; 1,130,647 to Thompson; 1,246,532 to Bosma; 1,547,221 to Lehrack; 2,719,347 to Brekke.

Of the above patents Bondi discloses a reusable modular abutment assembly having units formed of angle iron that can be stacked upon one another and abut forming plates for a wall. Knudson is directed to a variable sized core for concrete walls and teaches uprights connected by a cross member and having a turnbuckle. Hoag discloses a concrete wall form with members whose lower ends, and plates attached to them, can pivot towards one another by means of screws. Further adjustment is provided by bolts in the straps that are a feature of the invention. The bolts can pass through a plurality of holes in various positions along the straps. Barstad discloses a concrete form yoke apparatus with a fixed frame in which plates can be moved towards one another by means of screws and inner plates are used for forming a hollow core. The inner plates can be moved towards and away from one another by means of toggles activated by bolts.

Bracey discloses a wall mold having a wedging mechanism that resembles the toggle arrangement disclosed in the patent to Barstad above. Thomas discloses a yoke in which vertical members are hingedly connected to a cross member. The vertical members can be pivoted towards and away from one another by tightening locking members on a rod. Thompson discloses a yoke mechanism particularly adapted for forming a hollow wall. There are outer members that are pivotable about bars by adjusting a turn buckle so that the device can be clamped below a cast section of a wall.

The mold plates are adjusted by means of a turn buckle and the outer plates pivot about arms. Bosma shows an apparatus for molding concrete walls but showing a link arrangement. By pulling on a handle wall members are caused to move towards each other so that the apparatus can be pulled upward from a cast wall section to a position in which it can form a hollow core for a further wall section to be added on top of the already cast section. Lehrack shows a concrete building form arrangement adapted to create a hollow wall. There are inner plates movable towards and away from one another by means of a shaft connected to a cam riding upon pins. The shaft can be turned by a handle and the cam arrangement then moves the inner plates towards and away from one another as required. Lehrack teaches toggles that space the inner plates from adjacent outer plates. By pulling on a vertical bar the toggles or links draw members together to apply the necessary pressure. An arrangement is also provided to apply pressure to separate the plates.

Brekke teaches vertical beams spaced apart by varying distances by the position of a bolt in various holes provided. By turning the head on a screw member the members can be made to pivot towards and away from one another.

Despite the relatively large number of suggestions in the prior art for forming clamps for use in pouring concrete little commercial success has been achieved and it is believed that this is due largely to the complexity of the structures disclosed and the fact that little can be done to avoid leaks and support the forms by evenly distributing the clamping force.

SUMMARY OF THE INVENTION

Accordingly the present invention seeks to provide simple equipment in which leaks are easily avoided and form support and alignment maintained.

Accordingly the present invention provides a clamping device for a concrete form to apply pressure to opposed panels that contact the concrete to mold it, the device comprising a yoke to enclose the opposed panels; the yoke comprising a cross member and arms at each end of the cross members extending, when the device is in its useful position, downwardly to surround the panels; open sides for the arm, each facing inwardly, towards the other arm; a pressure member within each arm reciprocable through the open side of the arm to vary the pressure applied by the pressure member; and means to force the pressure member outwardly.

DRAWINGS

Aspects of the invention are illustrated, merely by way of example, in the accompanying drawings in which.

DESCRIPTION OF THE PREFERRED EMBODIMENTS

Figure 1:
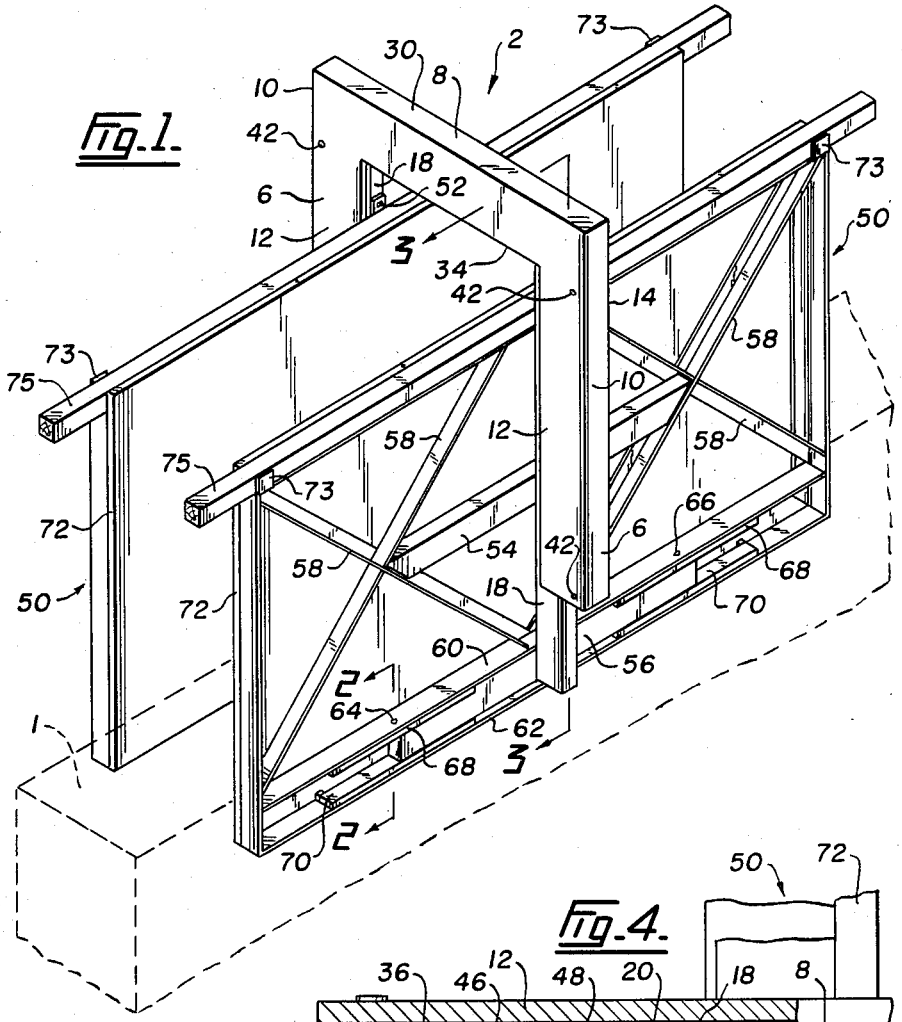
FIG. 1 is an isometric view of a preferred embodiment of the present invention.
Figure 2:
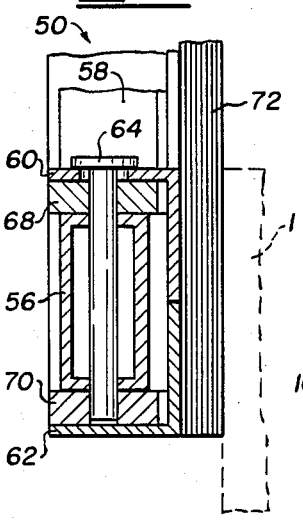
FIG. 2 is a section on the line 2—2 in FIG. 1.
Figure 4:
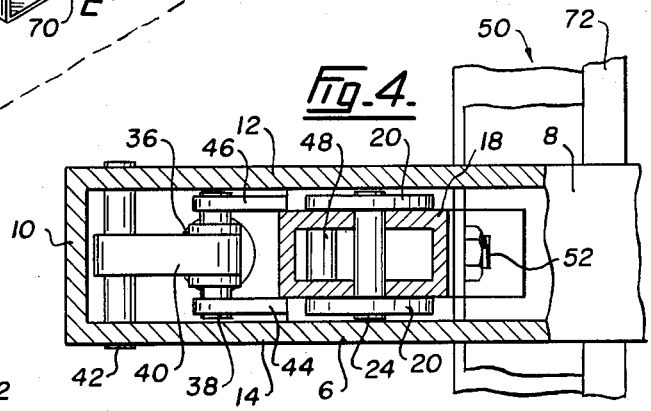
FIG. 4 is a section on the line 4—4 in FIG. 3.
Figure 5:
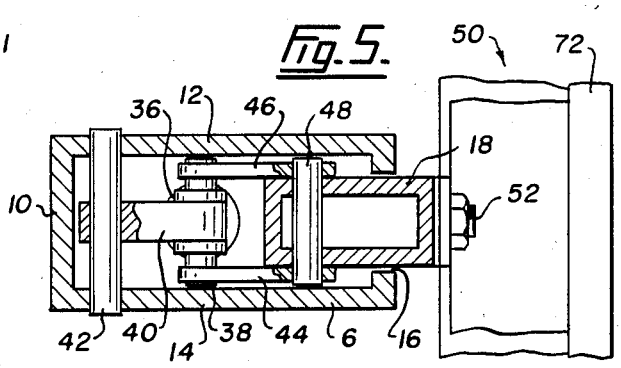
FIG. 5 is a section on the line 5—5 in FIG. 3.

The drawings show a device, generally indicated at 2, having an inverted U-shaped yoke comprising two arms 6 and a horizontal cross member 8. The arms are identical to each other and, in subsequent discussion, only one arm will be described. Each arm comprises an outer edge 10 and opposing sides 12 and 14 with an aperture 16, opposite edge 10, extending the full length of the arm. Cross member 8 is of hollow section as shown particularly in FIG. 3.

There is a pressure member in the form of beam 18 slidably mounted within cross member 8 by the provision of rollers 20 and 22. Each roller has a central axle 24. The rollers are disposed at the upper end of the beam 18 so that rollers 20 abut underside 28 at top edge 30 of cross member 8 and roller 22 sits on inner surface 32 of bottom edge 34 of the cross member 8. The beam 18 is thus suspended from the underside of cross member 8 and is able to move transversely within it but is, at the same time, housed in arm 6 by the aperture 16.

Within arm 6 is a hydraulic cylinder 36. At each end of the cylinder there is a pin 38. A finger 40, with a hole at each end, is pivotally mounted on the pin 38. The opposite end of each finger 40 is pivotally attached by pin 42 to the arm 6. Pin 42 extends through both sides of the arm 6 and is of a length equal to the thickness of the arm. Two similar fingers 44 and 46 are pivotally mounted on the ends of pin 38, adjacent finger 40. The ends are located on a third pin 48 which extends through beam 18. An identical arrangement is shown at the opposite end of the cylinder.

A frame 50 is secured to beam 18 by bolts 52 which are received in bracing members 54 and 56 and 50 itself. The configuration of the frame provides stiffness. Diagonals 58 are provided for extra stiffening and, again for rigidity, the frame is of angle bar.

There is a lower bracing member 56 enclosed within a channel formed by two horizontal track members 60 and 62. Member 56 is secured by pins 64 and 66 at each end. Reinforcing members 68 and 70 also act as spacers. The frame 50 is assembled in such a way that members 56, 54, 68, 70 and 58 are under bending and bowed slightly outwardly at the middle. Frame 50 abuts panels 72, typically of plywood or the like, which are smooth surfaced and abut the concrete, as shown particularly in FIG. 1.

The load distribution provided by this bending of the members is important in the present invention. The bowing outwardly of the members 54, 56, 68, 58 and 70 ensures that as the opposing panels 72, forced by the frames 50, are closed together a preloading force is applied that ensures a tight fit between panel 72 and the wall face 1. If members 54, 56, 58, 68 and 70 were mounted rigidly and flush on the frame 50 no such preloading would take place so that excess force would be applied to the middle of the edge of the panel compared with the outer end if leaking at the middle were to be avoided.

Figure 3:
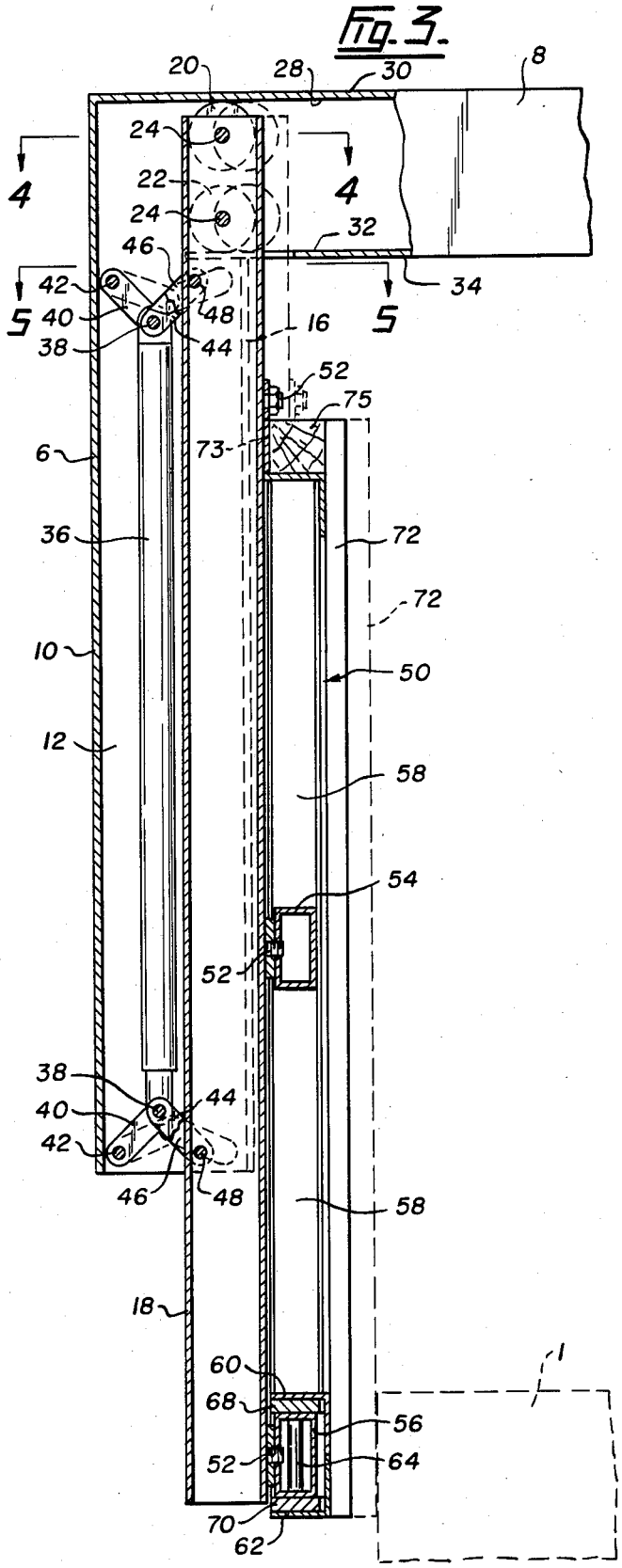
FIG. 3 is a section on the line 3—3 in FIG. 1.
Figure 6:
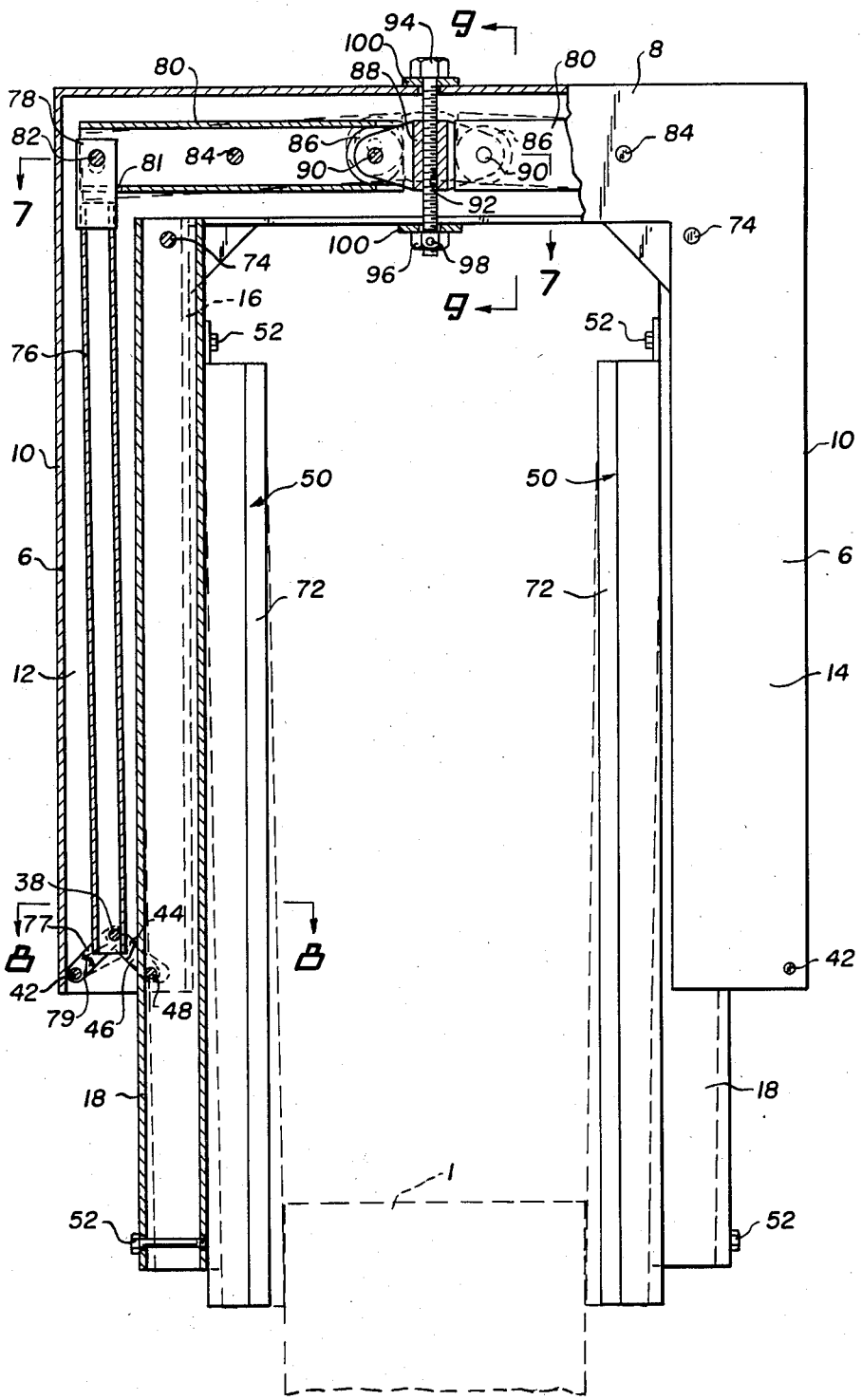
FIG. 6 is an alternative embodiment of the invention.
Figure 7:
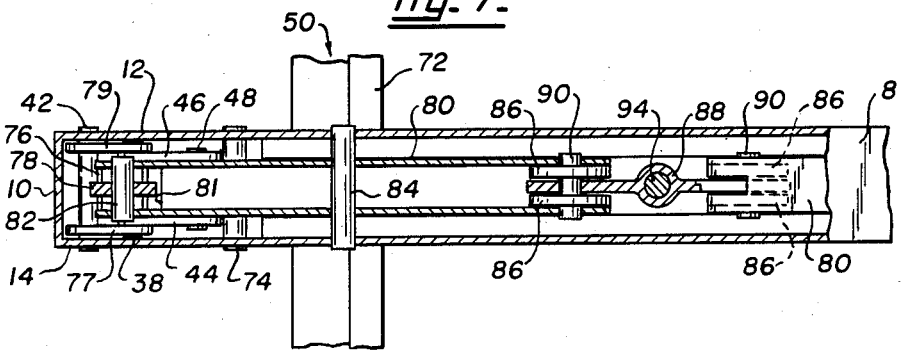
FIG. 7 is a section on the line 7—7 of FIG. 6.

FIGS. 1 and 3 show the use of an upper edge of the frame 50 as support brackets 73 to receive an elongated member 75, which extends beyond one frame 50 to engage the next frame 50 to maintain alignment of all the frames 50 along a wall.

The device operates as follows. Form 72 is positioned over a wall 1 in the manner shown in FIG. 1. A hydraulic pump (not shown) is activated to force fluid into cylinder 36 causing it to expand. As it does so fingers 40, 44 and 46 are pivoted round their respective pins and spread apart. Fingers 44 and 46 push directly on beam 18 while, eased by rollers 20 and 22, the beam slides outwardly to bring frame 50, and the carried panel 72, into contact with the wall face—see FIG. 3. Simultaneously an identical operation is being performed within the other arm 6 of the form.

Bowed, inner bracing members 54, 56, 58, 68 and 70 forced inwardly and, as the clamping force is increased, straightened, thus preloading the lower edge of the panel and ensuring a tight seal. Member 56 imposes a similar loading on members 68 and 70 as does 54 on 58. Concrete is then poured between the two panels 72 and left to set. When the concrete is set the hydraulic pressure is relieved and the form removed.

It should be noted that bracing members 54, 56, 58, 68 and 70 may be bowed to start then straightened or straight to start then bowed as force is applied.

A second embodiment of the invention is illustrated in FIGS. 6 through 9.

A similar inverted U shaped yoke comprising two arms 6 and a horizontal cross member 8 is employed. Each arm again comprises edge 10 and sides 12 and 14, with an aperture 16 formed opposite side 10 and extending the full length of the arm 6.

However, in this embodiment beam 18 is suspended from the underside of cross member 8 by a pin 74 whose ends are pivotally mounted in the arm 6.

A frame 50, secured to beam 18 by bolts 52, is identical to that previously disclosed.

Figure 8:
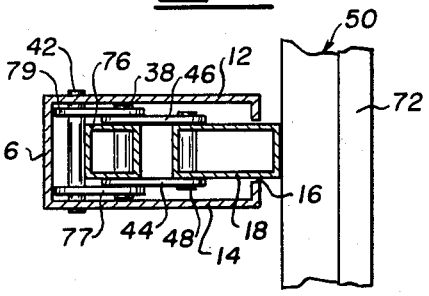
FIG. 8 is a section on the line 8—8 of FIG. 6.
Figure 9:
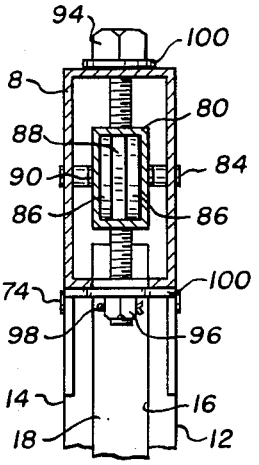
FIG. 9 is a section on the line 9—9 of FIG. 6.

Frame 50 and beam 18 are moved from an inoperable to a working position by means of a similar finger and pin arrangement disposed at one end of rectangular tube 76. Identical pins 38, 42 and 48 are employed as are identical fingers 44 and 46. However, due to the rectangular shape of tube 76, it has been found two fingers 77 and 79 are preferred to perform the job of finger 40 of the previous embodiment, as best shown in FIG. 8. A plate 78 is secured to the opposite end of tube 76. A second shorter rectangular tube 80 of larger cross sectional area has an aperture 81 formed in its lower surface in which plate 78 is received and pivotally mounted therein by means of a pin 82 extending through tube 80 and plate 78. Tube 76 is thus also free to pivot. The tube 80 is itself pivotally mounted in cross member 8 by means of a pin 84 which extends through its middle. A pair of rollers 86 are received in the open end of tube 80 and also carried in a member 88 by an axle 90. All of the aforementioned components are also found in the opposite arm 6, although member 88 is shared by both arms, as can be seen most clearly in FIG. 6. A threaded aperture 92 extends through member 88 and a large bolt 94 is received in it. The bolt 94 also extends through both horizontal surfaces of the cross member 8. A castellated nut 96 secures bolt 94 in position. A pin 98 is provided to ensure the nut 96 does not become displaced and washers 100 are provided under the head of the bolt 94 and beneath nut 96. It should be noted that aperture 92 in member 88 is threaded whereas the apertures formed in cross member 8 are not and are, in fact, of a slightly larger diameter than bolt 94. This is essential for proper functioning of the invention as will be appreciated in the following discussion of the operation of the device.

Form 72 is positioned over a wall 1 in the manner shown in FIG. 1, as before. Bolt 94 is then tightened (i.e. turned in a clockwise direction) using a suitable tool. This draws member 88 upwardly and causes tube 80 to pivot about pin 84. Rollers 86 ensure a smooth, linear pivotal movement. Further pivoting of tube 80 forces rectangular tube 76 downwardly which acts to spread fingers 44, 46, 77 and 79 apart. This causes beam 18 to pivot inwardly about pin 74 and thus bring the lower edges of panel 50 and the carried panel 72 into firm contact with the wall face. The preloading of the lower edge of the panel 50 against the wall face is achieved in a manner identical to that previously disclosed.

Figure 10:
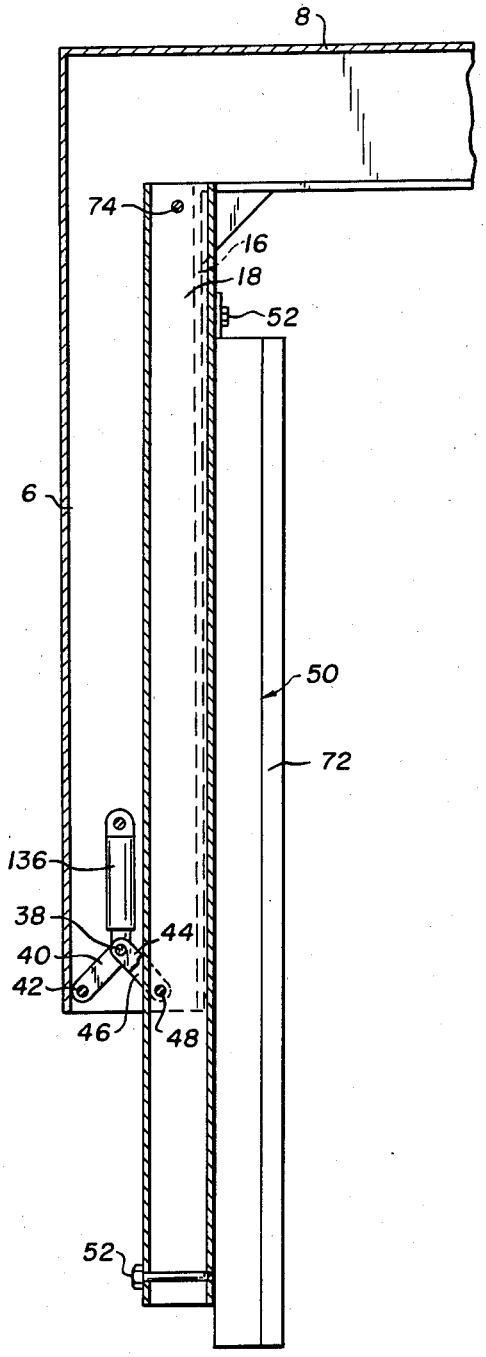
FIGS. 10 and 11 show details of two further embodiments.

FIG. 10 shows a simple embodiment of the invention in which parts common to the early embodiments are identified by the same reference numbers. The simplicity in the FIG. 10 embodiment arises from the use of a simple hydraulic or the like jack 136 to activate the linkage of pins 38, 42 and 48 and fingers 40, 44 and 46. At the top there is a simple pivoting of beam 18 about pin 74, reflecting the fact that a good seal is required at the bottom of the freshly poured concrete only.

In operation form 72 is positioned as before. Force is applied to the hydraulic jack 136, for example by the turning of the screw of the jack or by the application of hydraulic fluid for a hydraulic jack, to move jack 136 so that it expands. Beam 18 is thus moved outwardly to apply pressure to the wall. The beam pivots about pin 74.

Once the concrete has been poured and the wall set the pressure is released from the jack and the form may then be removed from the wall. The procedure is repeated, as before, for succeeding levels of the wall.

Figure 11:
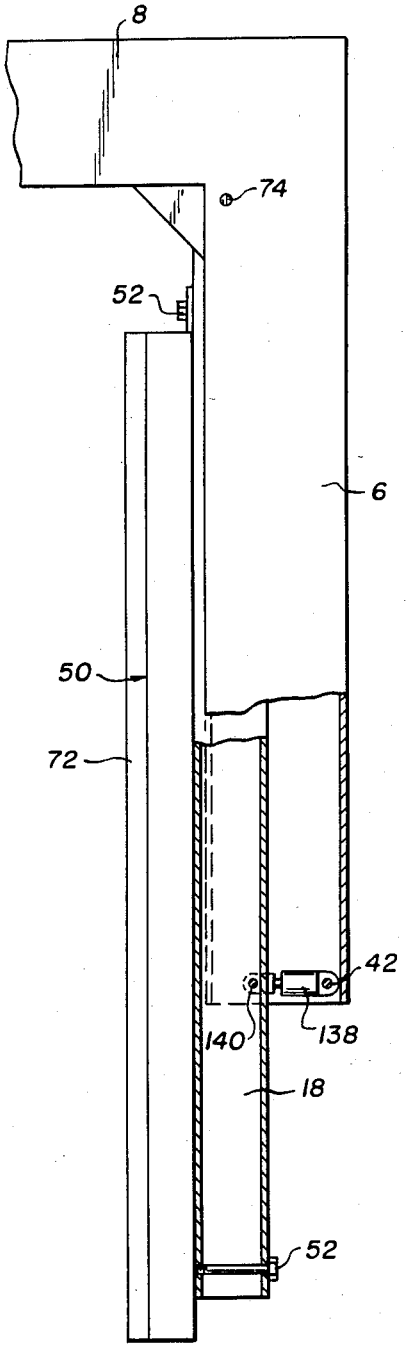

In FIG. 11 a simple hydraulic jack 138 is mounted horizontally to pivot at 140 and about pin 42. The FIG. 11 embodiment operates precisely as the FIG. 10 embodiment.

In all embodiments the clamping action maintains the alignment of the form panels and supports the device. If required, spacers may be inserted between beam 18 and the panels 72. This allows for construction of walls of variable cross section. Again this applies to all embodiments.

The present invention thus provides a leak proof system of pouring concrete and yet the pouring takes place in relatively small sections.

I claim:

1. A clamping device for concrete forms to apply pressure to opposted form panels that contact and mold concrete, the device comprising:

a yoke to receive the opposed form panels;

the yoke comprising a cross member and arms at each end of the cross member extending downwardly to receive the panels;

each arm being of open channel section with the opening in each channel facing inwardly towards the other arm;

a pressure member corresponding to and within each arm reciprocable through the opening of the channel section of the arm to vary the pressure applied by the pressure member; and means to force each pressure member outwardly comprising a fluid cylinder to force the corresponding said pressure member outwardly of its corresponding arm and inwardly with respect to the yoke, each said fluid cylinder including a piston, reciprocable within the cylinder and a piston rod attached to the piston and extending outwardly of the cylinder, and a pair of linking members pivotally attached to each end of the corresponding said fluid cylinder, one member of each said pair of linking members also being pivotally attached to the corresponding pressure member and the other link of each said pair also being pivotally attached to the corresponding said arm whereby extension of the piston rods of the cylinders acts to force the pressure members outwardly of their corresponding said arms.

2. A device as claimed in claim 1 in which the cross member is of hollow cross section having an interior and an exterior.

3. A device as claimed in claim 1 in which the pressure members each comprise a beam located within each arm.

4. A device as claimed in claim 2 in which the pressure members are each adapted to move within include rollers contacting the interior of the cross member to guide and locate the pressure member within a corresponding said arm.

5. A device as claimed in claim 1 in which the fluid cylinders are hydraulic cylinders.

6. A device as claimed in claim 1 including frames moved by the pressure members to abut the panels, said frames being attachable to the pressure members.

7. A device as claimed in claim 6 in which each frame includes a generally horizontal channel at its lower end;

bracing members corresponding to each channel and located in the corresponding channel and pivotally attached to the corresponding said channel and rigidly attached to the corresponding pressure member whereby the frame can be prestressed at its lower end to ensure uniform contact with the concrete after forcing outward of the pressure members.

8. A device as claimed in claim 1 in which the means to force each pressure member outwardly comprises a first member located within each arm;

first pivotal links attaching the first member to the corresponding arm and to the corresponding pressure member;

a second member located within the cross member having upper and lower ends and each pivotally attached at the upper end to the corresponding first member adjacent an outer end of the cross member;

a fulcrum for each second member in the cross member;

means to raise and lower the inner ends of each said second member within the cross member whereby raising the inner end of the second member acts to pviot the second members about each fulcrum to force downwardly the first members to move the pressure member outwardly at its respective arm and inwardly with respect to the yoke by pivoting of the first pivotal lniks.

9. A device as claimed in claim 8 in which the means to raise and lower the inner ends of each second member comprises a bolt extending through the cross member;

a threaded boss to receive the bolt;

rolling means attached to the threaded boss to engage the second members, whereby rotation of the bolt can raise the threaded boss to raise the inner ends of the second members.

10. A device as claimed in claim: 9 in which the second members are tubular and dimensioned to receive the rolling means within their interiors.

11. A clamping device for concrete forms to apply pressure to opposed form panels that contact and mold concrete, the device comprising:

a yoke to receive the opposed form panels;

the yoke comprising a cross member and arms at each end of the cross member extending downwardly to receive the panels;

each arm being of open channel section with the opening in each channel facing inwardly, towards the other arm;

a pressure member within each arm reciprocable through the opening of the open channel section of the arm to vary the pressure applied by the pressure member;

means to force each pressure member outwardly of its respective arm and inwardly with respect to the yoke;

frames moved by the pressure members to abut the panels, said frames being attachable to the pressure members;

each frame including a generally horizontal channel at its lower end;

bracing members located in each channel, pivotally connected to the channel and rigidly attached to a respective pressure member whereby the frame can be prestressed at its lower end to ensure uniform contact with the concrete after forcing outward of the pressure members.

12. A clamping device for concrete forms to apply pressure to opposed form panels that contact and mold concrete, the device comprising:

a yoke to receive the opposed form panels;

the yoke comprising a cross member and arms at each end of the cross member extending downwardly to receive the panels;

each arm being of open channel section with the opening in each channel facing inwardly, towards the other arm;

a pressure member within each arm reciprocable through the opening of the open channel section of the arm to vary the presure applied by the pressure member;

means to force each pressure member outwardly of its respective arm and inwardly with respect to the yoke, the means to force each pressure member outwardly of its respective arm and inwardly with respect to the yoke comprising a first member located within each arm;

first pivotal links attaching the first member to each arm and to each pressure member;

second members located within the cross member, each pivotally attached to a first member adjacent an outer end of the cross member;

a fulcrum for each second member in the cross member;

means to raise and lower the inner ends of each second member within the cross member whereby raising the inner end of the second member acts to pivot the second members about each fulcrum to force downwardly the first members to move the pressure member outwardly by pivoting of the first pivotal links.

13. A device as claimed in claim 12 in which the means to raise and lower the inner ends of each second member comprises a bolt extending through the cross member;

a threaded boss to receive the bolt;

rolling means attached to the threaded boss to engage the second members, whereby rotation of the bolt can raise the threaded boss to raise the inner ends of the second members.

14. A device as claimed in claim 13 in which the second members are tubular and dimensioned to receive the rolling means within their interiors.

* * * * *